United States Patent [19]

Manolis

[11] Patent Number: 4,515,137

[45] Date of Patent: May 7, 1985

[54] CRANKCASE EMISSIONS DEVICE

[76] Inventor: John Manolis, P.O. Box 380, New York, N.Y. 10028

[21] Appl. No.: 578,077

[22] Filed: Feb. 8, 1984

[51] Int. Cl.[3] ..... F02M 25/06

[52] U.S. Cl. ..... 123/572; 123/573; 123/574

[58] Field of Search ..... 123/572, 573, 574

[56] References Cited

U.S. PATENT DOCUMENTS

| | | | |
|---|---|---|---|
| Re. 30,682 | 7/1981 | Bush | 123/573 |
| 1,911,758 | 5/1933 | Knowles | 123/572 |
| 2,731,958 | 1/1956 | Robley | 123/572 |
| 3,073,293 | 1/1963 | Barker | 123/572 |
| 3,250,263 | 5/1966 | Gerjets | 123/572 |
| 3,266,474 | 8/1966 | Crandall | 123/572 |
| 3,362,386 | 1/1968 | McMahon | 123/572 |
| 3,524,437 | 8/1970 | Crandall | 123/572 |
| 3,587,544 | 6/1971 | Miles | 123/572 |
| 3,765,386 | 10/1973 | Ottofy | 123/572 |
| 3,779,221 | 12/1973 | Gartner | 123/572 |
| 3,875,916 | 4/1975 | Patton | 123/572 |
| 4,011,846 | 3/1977 | Gagliardi | 123/572 |
| 4,100,898 | 7/1978 | Mineck | 123/572 |
| 4,124,007 | 11/1978 | Mansfield | 123/572 |
| 4,136,650 | 1/1979 | Monookian, Jr. | 123/572 |
| 4,137,878 | 2/1979 | Mineck | 123/573 |
| 4,171,173 | 10/1979 | Voges | 123/572 |
| 4,245,592 | 1/1981 | Atkins, Sr. | 123/572 |
| 4,370,971 | 2/1983 | Bush | 123/573 |
| 4,381,755 | 5/1983 | Caracciolo | 123/573 |

FOREIGN PATENT DOCUMENTS

| | | | |
|---|---|---|---|
| 620572 | 4/1927 | France | 123/573 |
| 999735 | 2/1952 | France | 123/572 |

*Primary Examiner*—Ronald H. Lazarus

*Attorney, Agent, or Firm*—Morgan, Finnegan, Pine, Foley & Lee

[57] ABSTRACT

An improved device for separating liquid from gases and vapors passing from the crankcase of an internal combustion engine to the intake manifold thereof and allowing return of the separated liquid to the crankcase, through a conduit interconnecting the crankcase with the intake manifold, the component comprising a restricting device positioned within the conduit providing a restricted flow path in the crankcase gases and vapors.

3 Claims, 10 Drawing Figures

CRANKCASE EMISSIONS DEVICE

BACKGROUND AND OBJECTS OF THE INVENTION

The present invention relates generally to internal combustion engines and, more particularly, to devices for separating certain liquid portions from certain vapors emitted by an internal combustion engine or the like.

During the operation of an internal combustion engine (e.g., a gasoline powered automobile engine), a small portion of the air-fuel mixture introduced into each combustion chamber escapes into the crankcase of the engine block by passing around the piston rings during the compression stroke, just before combustion. In a like manner, immediately after combustion, a small amount of the gases resulting from combustion is forced past the piston rings and into the engine crankcase. These gases, commonly known as blow-by gases, collect in the crankcase and are subsequently directed into the intake manifold, as explained below.

Approximately 80% of all blow-by gases originate from uncombusted air-fuel mixture, while the remaining 20% consists of combustion products, including water vapor, carbon dioxide, carbon monoxide and oxides of nitrogen. However, during engine operation, oil vapors continuously rise from heated engine lubricating oil and mix with the blow-by gases. In addition, when an engine has not been running for some time, it has been found that a small amount of fuel vapors will enter and collect in the crankcase.

The presence of the blow-by gases and the fuel and, particularly, oil vapors (hereinafter referred to collectively as "crankcase vapors") in the crankcase can cause the formation of various deposits and acids which adversely affect engine life and performance if allowed to remain in the crankcase for extended periods of time. In addition, if the crankcase vapors are improperly vented, not only can they cause poor engine performance but they can also have an adverse impact on the environment.

In order to eliminate the crankcase vapors safely and efficiently, modern internal combustion engines incorporate a positive crankcase ventilation ("PCV") system which directs the crankcase vapors from the crankcase to the intake manifold for introduction into the combustion chambers. The PCV systems generally include a hose (about $\frac{3}{8}''$ to $\frac{5}{8}''$ in inner diameter) which communicates the crankcase with the intake manifold with an air flow control valve, or PCV valve, in the flow path of the hose for regulating the flow of air into the intake manifold according to either the amount of the intake manifold vacuum or the amount of pressure or vacuum in the engine crankcase.

Although conventional PCV systems have been effective in removing crankcase vapors and introducing them into the intake manifold for combustion, they have the disadvantage of also allowing the introduction of certain liquid vapor contaminents (particularly the heavier, non-combustible oil vapors) contained in the crankcase vapors into the combustion chambers. The liquid contaminants can interfere with the combustion process causing poor engine performance and creating exhaust emissions which have undesirable effects on the environment.

Many crankcase emission control devices have been proposed for preventing the liquid contaminant from reaching the intake manifold and the combustion chambers during engine performance. Such devices, however, utilize filters or valve means which are expensive to produce, and difficult and cumbersome to use, or which interfere with the vapor flow in such a way as to be undesirable for use in an internal combustion engine.

U.S. Pat. No. 4,136,650, for example, discloses a filter device connected between the PCV valve and the intake manifold. The device includes a housing which contains a filter element, such as wool, for filtering the crankcase vapors and an air check valve for returning oil collected in the bottom of the filter to the crankcase. Although this filter device may operate adequately to separate liquid and solid contaminants from the vapor passed through the filtering element, there is the danger that the filtering element will become clogged with contaminants and thereby prevent, or at least impede, further gas flow through the PCV hose. As a result, the spark plugs of the engine will likely begin to foul and the air-fuel mixture will require enrichment in order to offset the loss of power, thereby increasing exhaust emissions due to the presence of unburned vapors and decreasing gas mileage as a result of incomplete combustion. In addition, the filtering element will require replacement, adding expensive servicing and material costs to the use of the device.

Other devices proposed for minimizing the amount of contaminants entering the intake manifold similarly utilize filtering means such as activated charcoal for absorbing crankcase vapors and other liquid and solid contaminants (U.S. Pat. No. 3,831,353) or alumina for absorbing phosphorus-containing compounds (U.S. Pat. No. 4,381,755). By and large, such devices encounter the same problems mentioned above.

Accordingly, it is a principal object of the present invention to provide a new and improved crankcase emissions device for removing liquid vapors from the crankcase emissions of an internal combustion or like engine. In addition, it is an object of the invention to provide such a crankcase emmissions device which enables the removed liquid vapors (particularly oil vapors) to return, in liquid form, back to the crankcase of the engine.

Another object of the present invention is to provide a new and improved crankcase emissions device which removes liquid contaminants from the crankcase vapors yet allows the remainder of the crankcase vapors to flow into the intake manifold of the engine for combustion.

A further object of the present invention is to provide a crankcase emissions device for removing liquid contaminants from the crankcase that pass to the intake manifold to prevent the engine spark plugs from being fouled by non-combustible residues.

It is yet a further object of the invention to provide a new and improved crankcase emissions device which decreases exhaust emissions by allowing the gas portion of crankcase vapors to flow into the intake manifold for complete combustion and the liquid portion, particularly oil, to return, as liquid, back to the crankcase.

It is also an object of the present invention to provide a new and improved crankcase emissions device which removes the liquid portion from the crankcase vapors without requiring any filter or like elements which would necessitate periodic replacement. In addition, the invention provides a crankcase emission device which is compact in size, simple and economical to fabricate, easy to install and needs no maintenance or servicing. Furthermore, the present invention makes it possible to save significant quantities of engine oil, particularly in diesel engines, reduce engine emissions, improve engine performance and mileage and reduce engine wear.

The foregoing and other objects and advantages of the invention will be apparent to those skilled in the art from the following detailed description when taken in conjunction with the accompanying drawings.

SUMMARY OF THE INVENTION

The present invention is directed to a crankcase emissions device for separating the liquid vapor portion from the crankcase vapors in an internal combustion engine. Briefly described, the device comprises means for restricting the flow path for the crankcase vapors before allowing the crankcase vapors to enter the intake manifold. According to one embodiment, the device comprises a vessel member having an inlet port at its bottom and an outlet port at its top. The inlet port includes a cylindrical inlet tube or other suitable member for connection to the PCV hose and the outlet port includes a cylindrical outlet tube which includes a portion extending inwardly of the vessel member. The interior portion of the outlet tube has a smaller diameter than that of the vessel to provide liquid-vapor separation means.

Advantageously and as preferably embodied, the vessel further includes baffle means interior thereof, which cooperate with the cylindrical outlet tube to enhance separation of liquid contaminants from the crankcase vapors introduced into the vessel. The baffle means may comprise a ring-like member within the vessel, which provides a second restricted flow area. Advantageously, the cylindrical outlet tube and/or baffle means may include deflecting means to help prevent any liquid collecting within the vessel from being drawn through the outlet tube and into the intake manifold.

In an alternative embodiment, the vessel member may be eliminated and the ring-like member may be inserted directly in the PCV hose. As preferably embodied, at least one baffle member is superimposed over the flow port thereof, on the upstream side.

It will be understood by those skilled in the art that the objects and advantages specifically enumerated herein are achieved by the invention as disclosed and embodied herein. Thus, it will be found that by providing the flow restriction vessel member and/or the baffle means disclosed herein in the flow path of the crankcase vapors emitted from an internal combustion engine, liquid vapor contaminants of the crankcase vapors will be separated from the crankcase vapors so as not to be introduced into the engine combustion chambers. In addition, it will be found that such liquid vapors will tend to condense and return, under the influence of gravity, back to the crankcase. As a result, the flow of oil and other harmful liquid contaminants into the intake manifold will be substantially reduced and fouling of spark plugs substantially lessened.

It will also be found that the crankcase emission devices according to the present invention are relatively easy and inexpensive to fabricate and will function automatically in an essentially passive manner so as to require virtually no maintenance.

It will be understood that the foregoing general description and the following detailed description are exemplary and explanatory of the invention and are not intended to be restrictive thereof. The accompanying drawings, referred to herein and constituting a part hereof, illustrate preferred embodiments of the invention, and, together with the description, serve to explain the principles of the invention.

BRIEF DESCRIPTION OF THE DRAWINGS

For a fuller understanding of the invention, reference is had to the following detailed description taken in connection with the accompanying drawings of preferred embodiments in which.

DETAILED DESCRIPTION OF PREFERRED EMBODIMENT

Figure 1:
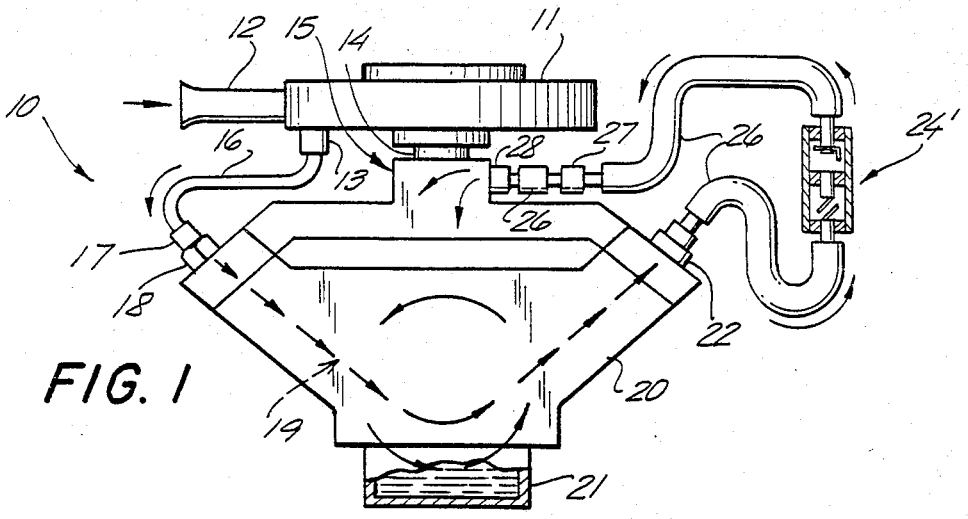
FIG. 1 is a schematic diagram of a conventional internal combustion engine showing an embodiment of the present invention installed in a PCV hose communicating the crankcase with the intake manifold.

Referring now more particularly to the accompanying drawings, wherein like reference numerals designate similar parts throughout the various views, FIG. 1 illustrates an exemplary internal combustion engine (designated generally by reference number 10) in which the present invention will have particularly advantageous utility. It will be understood that the present invention is not limited to use with a V-type gasoline-powered engine, but may be used in connection with various internal combustion engines such as diesel engines, etc. Since familiarity with internal combustion engines is assumed, operation of engine 10 will be briefly described only to the extent believed necessary to facilitate a complete understanding of the present invention.

In operation of engine 10 (ignoring, for the moment, the presence of the crankcase emissions device according to the present invention), air flows into air filter 11 through air intake duct 12. Some of the air entering duct 12 is directed via conduit 16 through breather cap 17 and engine aperture 18 into crankcase 19 of engine block 20. Oil pan 21 provides a reservoir of lubricating oil for circulation through crankcase 19. Thus, as engine 10 is operated, the lubricating oil is heated and emits oil vapors which are trapped in crankcase 19.

As indicated in FIG. 1, the crankcase vapors which collect in crankcase 19 flow through outlet port 22 of crankcase 19 into PCV hose 26 and into the intake manifold from which they are introduced into the combustion chambers. Consequently, several contaminants and liquid vapors (particularly oil vapors) will likewise be introduced into the combustion chambers. It is, therefore, a principal purpose of the present invention to provide a liquid-vapor separator which separates at least some of the liquid portion of the vapors exiting the crankcase and prevent such liquid portion from being introduced into the intake manifold for combustion with the fresh air-fuel mixture.

Turning then to FIGS. 2–9, there are shown various embodiments of the crankcase emissions device according to the present invention. According to one general embodiment of the invention (illustrated in FIGS. 2–7), the crankcase emissions device according to the invention comprises a vessel or container (indicated generally at 24) which permits expansion of the crankcase vapors passing through the PCV hose but then restricts the flow path in order to remove the liquid vapor portion.

Figure 2:
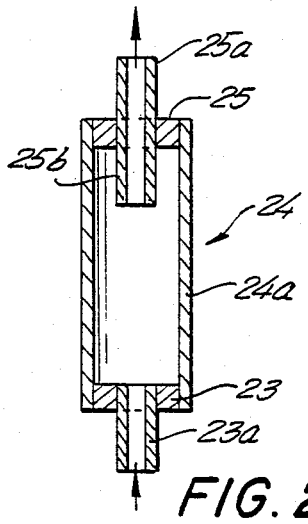
FIG. 2 is a sectional view of one embodiment of the present invention.

As shown in FIG. 2, vessel 24 includes a generally cylincrical housing wall 24*a* having a bottom wall 23 at its lower end, with inlet port means formed therein, and a top wall 25 at its upper end, with outlet port means formed in top wall 25. The inlet port means comprise an opening (not numbered) formed in bottom wall 23 and a cylindrical inlet tube 23*a* extending outwardly from wall 23. The outlet port means comprises a similar opening (also not numbered) formal in top wall 25, with a cylindrical outlet tube 25*a* extending outwardly from the top member 25. As preferably embodied, a further cylindrical tube 25*b* extends inwardly into the interior chamber of the vessel from the interior surface of top 25.

In the operation of the invention, with the PCV valve open to allow flow through PCV hose 26, crankcase vapors are forced out of the crankcase, through the first segment of the PCV hose and thence through inlet tube 23*a* of vessel 24. Once past inlet tube 23*a*, the vapors enter the interior vessel chamber wherein the vapors are free to expand. As the vapors expand, they will tend to flow upwardly along the interior surface of the vessel wall and will collect, or condense, as a film of liquid on the wall. The continuing pressure generated by further incoming crankcase vapors will force the remaining gaseous portion of the crankcase vapors out through the outlet port means. It will be understood that the internal portion of outlet tube 25*a* provides a further wall surface on which liquid vapor can collect or condense as well as a recessed exit port to insure that condensed liquid will not simply flow out of vessel 24 with the remaining gases.

The liquid collected on the vessel walls will return to crankcase 19 by virtue of gravitational forces either during operation of the engine or after the engine stops. Thus, it is preferred that the vessel be oriented in a generally vertical configuration with outlet tube 25*a* at the top.

Figure 3:
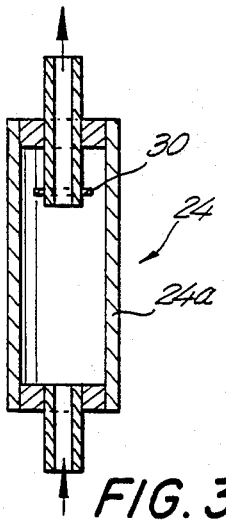
FIGS. 3 and 4 are sectional views of modified versions of the embodiment illustrated in FIG. 2, showing exemplary deflection means according to the invention.

Advantageously, the outlet tube portions 25*a* and 25*b* are of a one piece integral metal tube, and the interior portion 25*b* is tapered at its bottom end within vessel 24 in order to further ensure that condensed liquid crankcase emissions will not exit therethrough. Also advantageously, and as best shown in FIG. 3, the bottom end of tube 25*b* is provided with deflecting means (here in the form of ring-like rim or ledge 30 which extends circumferentially around tube 25*b* and projects outwardly therefrom) for further ensuring that any liquid which might collect on the exterior surface of tube 25*b* will be directed away from its interior port. The embodiment of FIG. 3 will operate in essentially the same manner as that of FIG. 2, except that rim 30 will keep liquid collected on tube 25*b* away from the lip of its interior port to minimize the chance of inadvertently exiting through outlet tube 25*b*. For most purposes, the width of rim or ledge 30 may be from about 1/16 in. to about 3/32 in.

Figure 4:
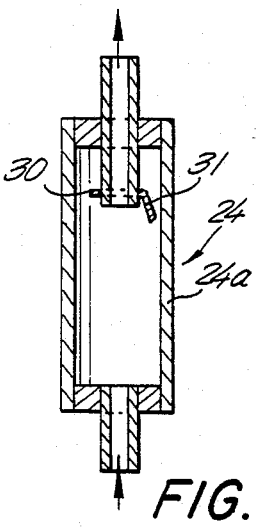

Referring now to FIG. 4, there is shown a further preferred modification of the structure shown in FIG. 3. As here embodied, the rim 30 on outlet tube 25*b* includes a flange member 31 depending from rim 30 and extending angularly away from the opening of outlet tube 25*b*. The flange 31 provides further deflecting means for directing any liquid collecting around rim 30 downwardly into the vessel. This will ensure that the liquid will be directed away from the opening of outlet tube 25*a*. In all other respects, the structure of FIG. 4 will operate like that of FIG. 3.

Figure 5:
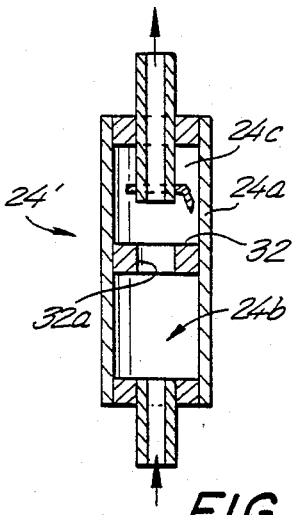
FIG. 5 is a sectional view of another embodiment of the present invention showing exemplary baffle means according to the invention.
Figure 6:
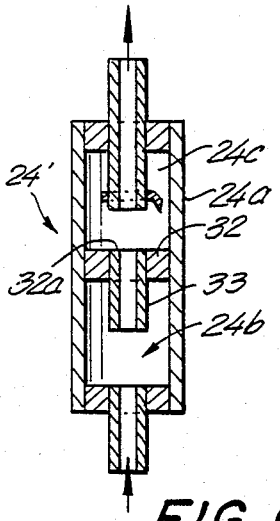
FIGS. 6 and 7 are sectional views of modified versions of the embodiment illustrated in FIG. 5, showing exemplary deflection means according to the invention.
Figure 7:
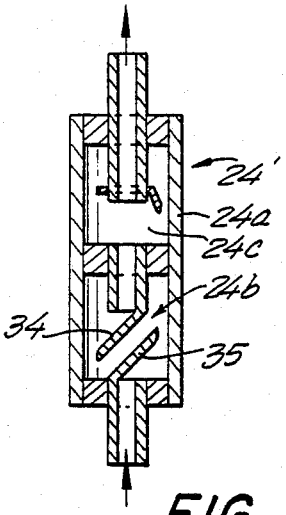

According to another feature of the present invention, the vessel may advantageously include baffle means within its interior chamber for further ensuring the separation of the liquid vapor portion from the crankcase vapors. As shown in FIGS. 5–7, the baffle means according to the invention include a flow restriction ring 32 fixed relative to the inner walls of the vessel (designated 24'), about midway between the outlet port and the inlet port. Ring 32 has an opening, or flow restriction port 32*a*, which is of approximately the same diameter as that of the outlet tube 25*a*.

As is apparent from FIGS. 5–7, ring 32 is adapted to further retard the upward flow of crankcase emission liquids by adding a second restriction to vapor flow within the vessel. It will be understood that baffle ring 32 effectively provides two vapor separation chambers (24*b* and 24*c*) to ensure maximum separation of the liquid vapor portion from the crankcase vapors. In operation, vapors entering lower chamber 24*b* will expand and travel upwardly along the interior wall surfaces of lower chamber 24*b* and tend to condense thereon or on the bottom surface of ring 32. The condensed liquid will tend to travel downwardly under the influence of gravity, while the remainder of the crankcase vapors will pass through port 32*a* and into upper chamber 24*c*. In the upper chamber, the vapors (now containing much less liquid vapor than the original crankcase vapors) will be subjected to the same separation operation as described with reference to FIGS. 2–4.

As preferably, embodied, an inter-chamber cylindrical tube 33 (FIG. 6), much like the interior outlet tube 25*b*, similarly depends downwardly from restriction port 32*a* of baffle ring 32. Tube 33 may also include a rim and/or flange arrangement much like rim 30 and flange 31 described above (as illustrated in FIG. 5). It will thus be understood that vapors entering the lower chamber 24*a* of vessel 24' will be subjected to the same separation as described above with respect to FIGS. 2–4. For example, tube 33 helps to prevent separated liquid in lower vessel chamber 24*b* from entering upper vessel chamber 24*c*, and, like tube 25*b*, baffle tube 33 may be tapered at its bottom end.

In a slightly modified version shown in FIG. 7, both baffle tube 33 and inlet tube 23*b* may be provided with internal deflector tabs 34 and 35, respectively, for further enhancing the liquid vapor separation in the vessel. Tab 34 may be integrally formed on baffle tube 33 and extend downwardly, substantially diagonally across the vertical axis of restriction port 32*a*. Tab 35 may be integrally formed at inlet tube 23*a* and extend upwardly, substantially diagonally across the liquid/vapor passage formed at the inlet port. Tabs 34 and 35 are spaced apart from each other so as to define a tortuous flow path for the crankcase vapors to further ensure ultimate separation of the liquid vapor portion.

In operation of the vessel illustrated in FIG. 7, the crankcase vapors enter the lower chamber 24*b* but are deflected away from baffle port 32 by tab 35. The vapors must then circulate around tab 35 and then tab 34 before reaching the mouth of baffle tube 33. As a result of the tortuous flow path, much of the liquid component of the crankcase vapors will condense on the various interior surfaces within lower chamber 24*b*. Any vapors passing through baffle tube 33 are thence subjected to essentially the same separation process as described above with reference to FIGS. 2–4. The separated liquid will flow downwardly under the influence of gravity and will exit through inlet tube 23. The remaining flow will enter upper chamber 24*c* wherein further liquid vapor will be removed, as described above.

Figure 10:
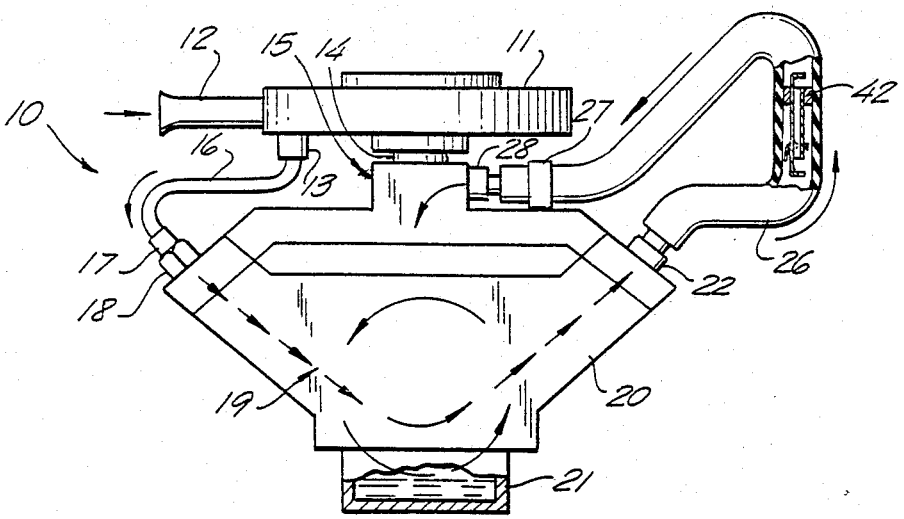
FIG. 10 is a schematic diagram, similar to FIG. 1, of an internal combustion engine showing installation of the embodiment of FIGS. 8 and 9.
Figure 9:
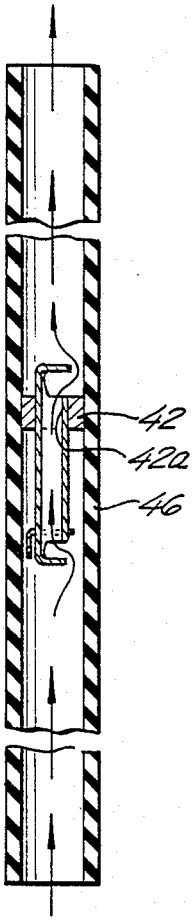
FIG. 9 is a sectional view of the embodiment of FIG. 8 installed directly in a PCV hose.
Figure 8:
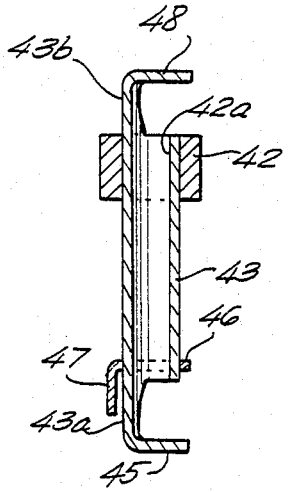
FIG. 8 is a sectional view of still another embodiment according to the present invention.

Turning now to FIGS. 8–10, there is shown a modified version of the present invention wherein the baffle means described above with reference to FIGS. 5–7 may be installed directly in the PCV hose, without requiring a vessel housing. As here embodied, the baffle means comprise ring member 42 (similar to ring member 32 described above) which is adapted to be held within the inner diameter of PCV hose 26. Ring 42 has a restriction port 42*a* (much like port 32*a* described above) to permit flow therethrough, and it includes a cylindrical tube 43 (much like tube 33 described above) which projects downwardly from ring 42 similar to tube 33.

As preferably embodied, tube 43 includes baffle means, here in the form of flange 45, which extends across the passage in tube 43 to block direct flow into tube 43, but which is spaced from the opening at the bottom end of tube 43 to provide access to the passage in tube 43. As here embodied, tab 43*a* extends downwardly from the bottom opening of tube 43 to space flange 45 therefrom, leaving a semi-cylindrical access space for flow through tube 43.

In operation, ring 42 is fixed in a generally vertical orientation within the PCV hose with tube 43 extending towards the crankcase side of the hose. As the crankcase vapors flow upwardly in the PCV hose, they will be blocked from direct flow into tube 43 by flange 45, causing the vapors to continue flow upwardly along both with the interior surface of the PCV hose and the exterior surface of tube 43 until reaching ring 42. Liquid vapors will tend to condense along these surfaces and flow downwardly under the influence of gravity, while the remaining, primarily gaseous, portion will tend to enter the semi-cylindrical access space behind flange 45 for passing through tube 43 and on to the intake manifold.

Advantageously, tube 43 includes a rim 46 (similar to rim 30 described above) as well as a downwardly extending tab 47 (similar to tab 31 described above) for preventing liquid collecting on the exterior surface of tube 43 from entering its interior passage, and to direct the liquid downwardly towards the crankcase. (It will be understood that liquid collecting on the inner wall surface of the PCV hose will simply flow as a thin film along that surface under the influence of gravity.)

Also as preferably embodied, a second baffle flange (designated 48) extends across passage 42*a* (similar to flange 45) and is spaced above ring 42 by a tube extension 43*b* similar to 43*a*. Flange 48 acts as a barrier to any liquid vapor which may be carried with gases passing through tube 43. The impact of such liquid vapor on baffle flange 48 will cause the liquid to collect thereon for downward flow back towards the crankcase. As a result, essentially liquid-free gases (at least substantially free of heavy liquid such as oil vapors) will remain to continue through the PCV hose to the intake manifold.

The baffle means FIGS. 8 and 9 are set within the PCV hose so as to have a vertical orientation as illustrated in FIG. 10. In addition, the ring 42 should fit relatively tightly within the PCV hose so that it remains stationary. To facilitate replacement of the baffle means, the PCV hose can be cut to permit insertion of ring at a desired location with half of ring 42 received in one of the cut ends and the other half set in the other end. For safety, the cut ends of the hose can be clamped around ring 42. In addition, it may be preferable to use a PCV hose having a slightly large inner diameter (e.g., about $\frac{5}{8}''$) than otherwise would be used (usually $\frac{3}{8}''$) to prevent any backing up of flow.

Since the construction and the advantages of the present invention may be readily understood from the foregoing embodiments, further explanation is believed to be unnecessary. However, since numerous modifications will readily occur to those skilled in the art from the foregoing specification and accompanying drawings, it is not intended that the invention be limited to any particular embodiment disclosed herein, but variations, modifications and equivalents may be made therefrom which fall within the scope of the appended claims.

What is claimed:

1. An improved device for separating liquid from gases and vapors passing from the crankcase of an internal combustion engine to the intake manifold thereof and allowing return of the separated liquid to the crankcase through a conduit interconnecting the crankcase with the intake manifold, the improvement comprising a restricting means providing a restricted flow path for the crankcase gases and vapors and a surface upstream of said restricted flow path for allowing separated liquid to collect thereon for return to the crankcase, said restricting means including a ring-like member adapted to be held in mating relationship with and within the conduit, said ring-like member having a port to allow fluid flow therethrough, a tube-like member extending from one side of said ring-like member and providing a flow passage with said port, and baffle means associated with said tube-like member generally to block direct flow into the flow passage of said tube-like member, yet allow access to the flow passage for flow through said tube-like member such that liquid associated with the crankcase gases and vapors will tend to collect at said device for return to the crankcase.

2. A device, according to claim 1, wherein said baffle means comprises a flange extending across the flow passage and a tube-like member spacing said flange slightly from said tube-like member to provide access to said flow passage.

3. A device, according to claim 2, which further includes baffle means at the port of said ring-like member, generally adjacent its outlet end.

* * * * *